US006079431A

United States Patent [19]

Su

[11] Patent Number: 6,079,431

[45] Date of Patent: Jun. 27, 2000

[54] UNDERARM CANE DEVICE

[75] Inventor: Dickson Su, Taipei Hsien, Taiwan

[73] Assignee: Maxhealth Corporation, Taipei, Taiwan

[21] Appl. No.: 09/345,765

[22] Filed: Jul. 1, 1999

[51] Int. Cl.[7] ..... A61H 3/02

[52] U.S. Cl. ..... 135/72; 135/68; 135/71; 403/379.2; 403/379.5

[58] Field of Search ..... 135/72, 71, 73, 135/68; 403/109.3, 109.6, 377, 378, 379.1, 379.2, 379.4, 379.5, 240, 347

[56] References Cited

U.S. PATENT DOCUMENTS

| | | | |
|---|---|---|---|
| 596,203 | 12/1897 | Drake . | |
| 705,741 | 7/1902 | Drew . | |
| 904,481 | 11/1908 | Hood . | |
| 2,669,244 | 2/1954 | Greene et al. | 135/72 |
| 4,647,241 | 3/1987 | Weber | 403/378 X |
| 5,291,910 | 3/1994 | Bui et al. | 135/72 X |
| 5,381,813 | 1/1995 | Miric et al. | 135/72 |

*Primary Examiner*—Robert Canfield

*Attorney, Agent, or Firm*—Bacon & Thomas

[57] ABSTRACT

An improved underarm cane device including a cane having a Y-type structure with an upper end portion and two rods extending therefrom. The arm supporter structure includes an arm supporter and two ends, with each end of the arm supporter structure having a ring through which each one of the two rods of the upper end portion of the cane extends through, in order to arrange the arm supporter structure between the two rods of the upper end of the cane. The rings each have an outer side with a through bore and a protrusion. The protrusions at the outer sides of the rings including a groove. Bores are longitudinally arranged along the length of each of the two rods. Locking pieces are configured to secure the arm supporter structure between the two rods wherein each of the locking pieces secures the arm supporter structure on the two rods. The device includes L-shaped locking pieces each having a centrally positioned tenon, and each of the locking pieces having an inner side and outer side. The device further includes a buckling piece having a distal end. The buckling piece and the pushing piece extend from the locking pieces and the distal end of the buckling piece is forked and formed with two elastic projecting portions.

1 Claim, 4 Drawing Sheets

UNDERARM CANE DEVICE

BACKGROUND OF THE INVENTION

1. Field of the Invention

The present invention relates to an improved structure of an underarm cane, wherein the underarm cane is provided with elastic locking pieces for being locked to or released from the holes of the two rods of a Y type cane.

2. Description of the Related Art

In the prior art cane, an arm supporter is formed with a round hole on the center of the arm supporter. When the arm supporter is disposed on the two rods of an Y type cane, the arm supporter must be aligned to the screw holes on the two rods. Then a long screw rod first passes through one hole on one of two rods, then the screw rod further passes through a round hole penetrating through the arm supporter, finally, the screw rod will protrude from the hole on the other rod. However, this prior art cane is very inconvenient as the height of the arm supporter is necessary to be adjusted. Since the long screw hole must be screwed out, and the fixing stud thereof must be detached. This action is very inconvenient for a handicapped person.

SUMMARY OF THE INVENTION

The primary object of the present invention is to provide an improved structure of the arm supporter of an underarm cane comprising a cane and an arm supporter structure. Wherein the cane has an; and structure, the arm supporter structure is arranged on the two rods on the upper end of the cane. A plurality of holes longitudinally arranged are formed on the two rods, the arm supporter structure is formed by an arm supporter and locking pieces. Two ends of the arm supporter have respective rings, outer side of each ring is installed with a through hole and the protrusion at one side of each ring is installed with a groove. The locking pieces have an L shape, and center thereof is formed with a tenon. The inner side and outer side of another end of each locking piece are extended with a buckling piece and a pushing piece, respectively. The distal end of the buckling piece is forked to be formed with two elastic projecting portions. According to aforementioned structure, by the tenon and the nozzle of the locking piece to be inserted into the through hole outside the ring of the arm supporter and the groove of the protrusion, the projecting portion of the buckling piece is buckled in the groove. Thus the tenon may be buckled in the hole at the rod of the Y type cane or the pushing piece at the locking piece is pushed for releasing the buckling structure in the hole on the rod of the Y type cane.

Another object of the present invention is to provide an improved structure of an underarm cane, wherein the underarm cane is provided with releasable locking pieces so that the tenon of each locking piece is locked to or released from the holes of the two rods of the Y-type cane.

The various objects and advantages of the present invention will be more readily understood from the following detailed description when read in conjunction with the appended drawing.

DETAILED DESCRIPTION OF THE PREFERRED EMBODIMENTS

Figure 1:
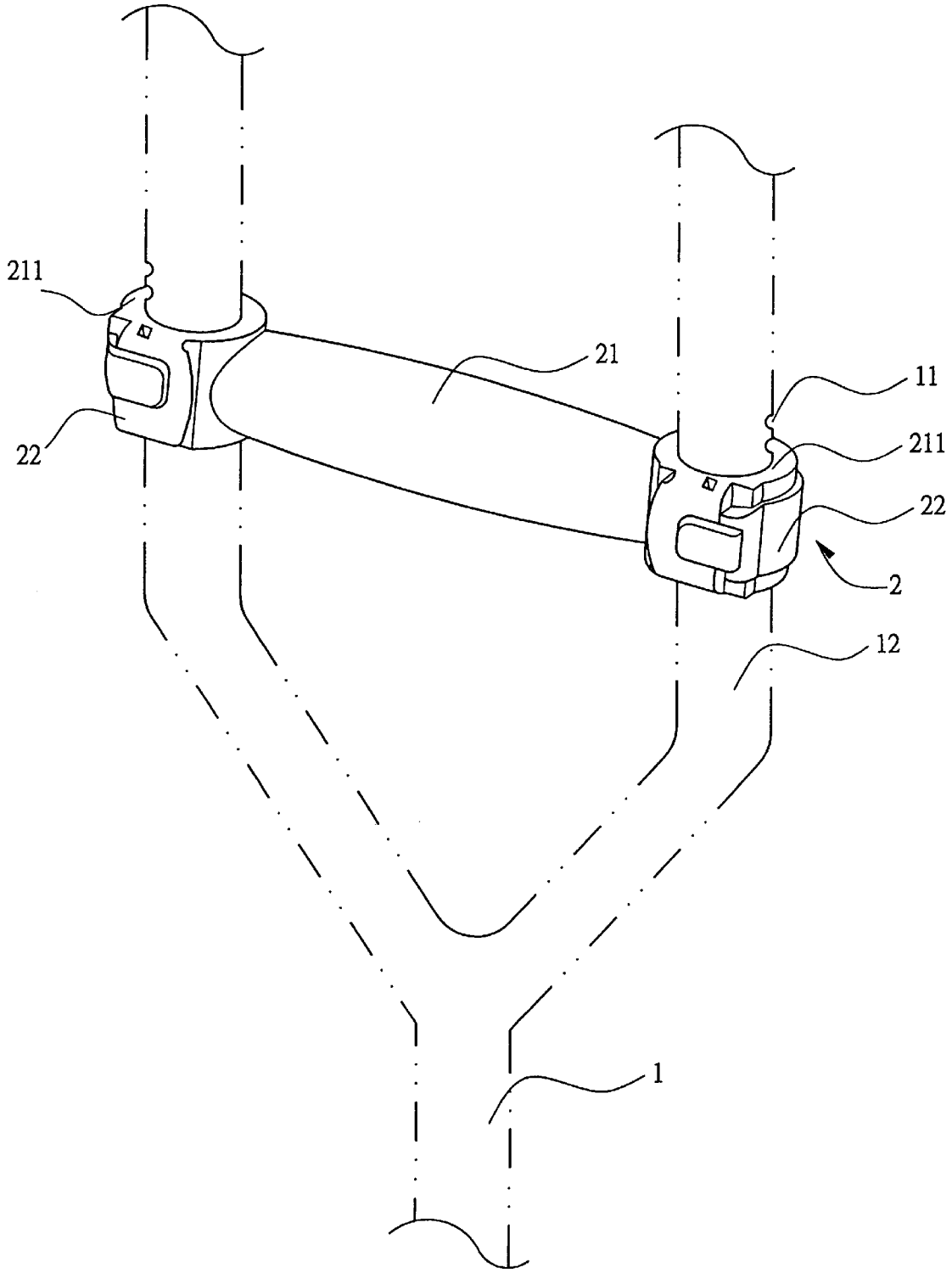
FIG. 1 shows a perspective view of the present invention.
Figure 2:
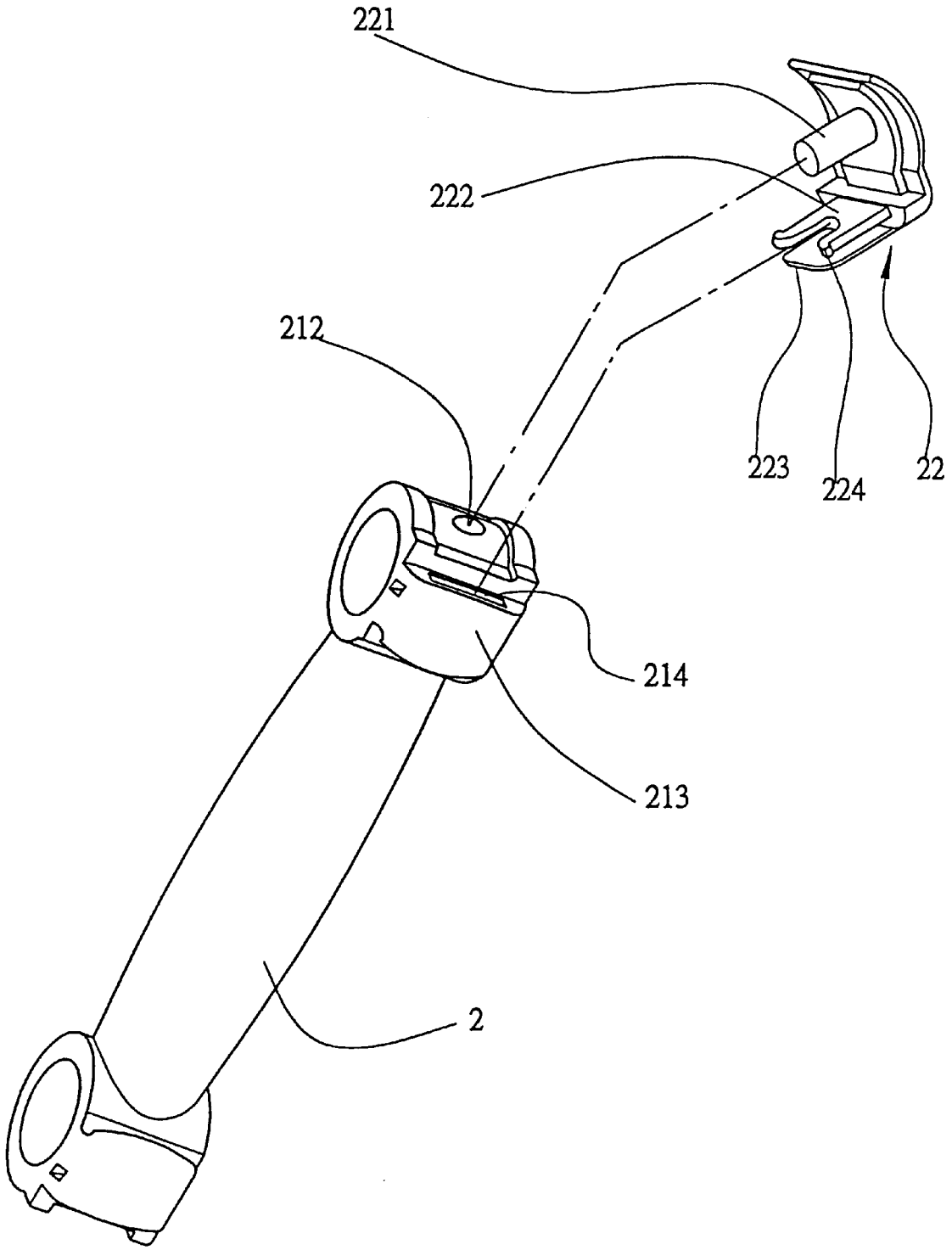
FIG. 2 is a exploded view of the present invention.
Figure 3:
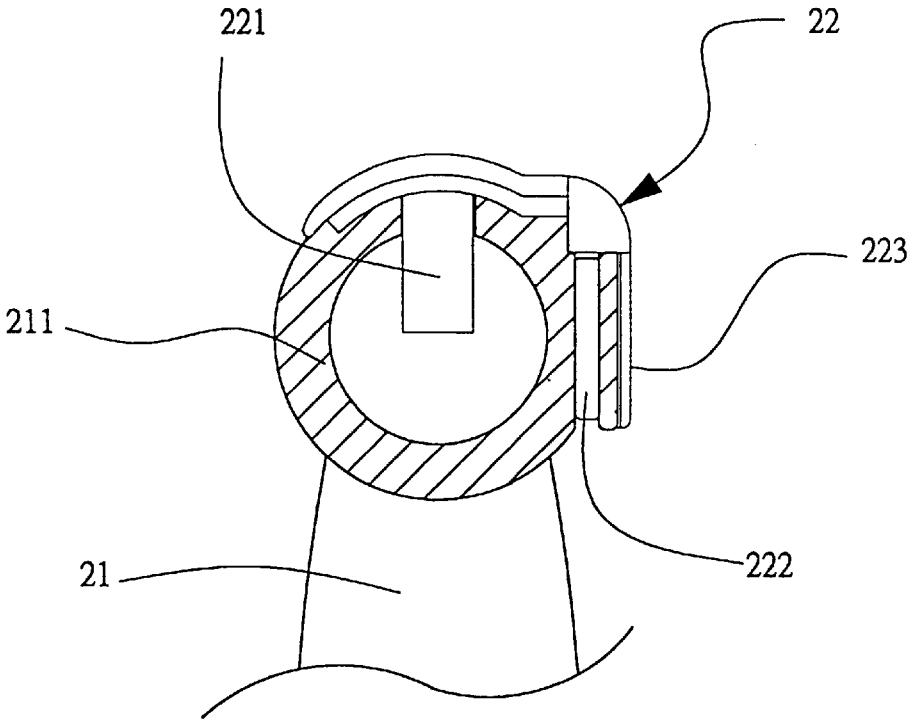
FIG. 3 is a cross section view showing the locking piece and ring of the present invention.
Figure 4:
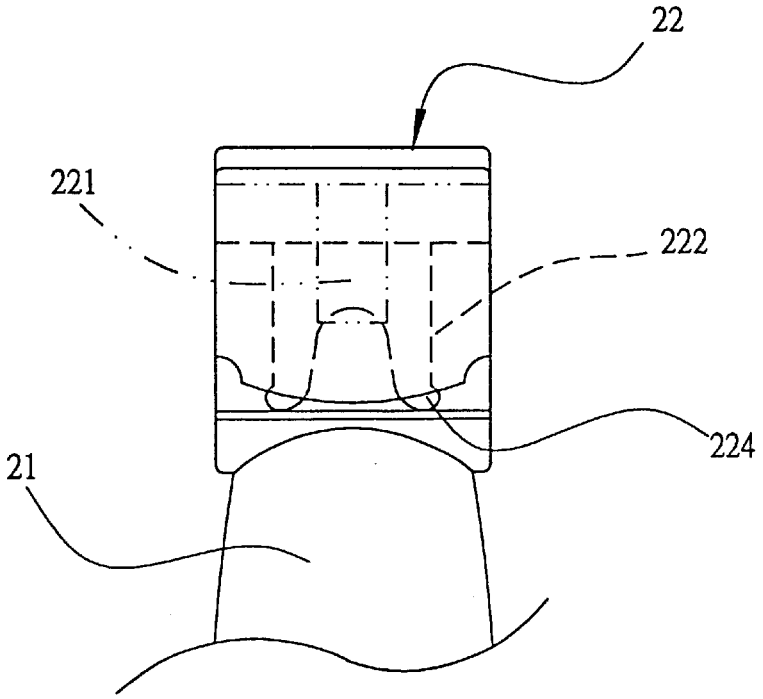
FIG. 4 is a schematic view showing the buckling of the locking piece and the ring.

With reference now to FIGS. 1~4, the underarm cane according to the present invention is illustrated. The underarm cane of the present invention includes a cane 1 and an arm supporter structure 2. The cane 1 has a Y-type structure. The arm supporter structure 2 is arranged on the two rods 12 on the upper end of the cane 1. A plurality of bores 11 longitudinally arranged are formed on the two rods 12. The arm supporter structure 2 is formed by an arm supporter 21 and locking pieces 22. Two ends of the arm supporter 21 have respective rings 211. The outer side of each ring 211 includes a thorough bore 212 and a protrusion 213 at one side of each ring 211 includes a groove 214. The locking pieces 22 have an L-shape, and center thereof is formed with a tenon 221. The inner side and outer side of another end of each locking piece 22 are extended with a buckling piece 222 and a pushing piece 223, respectively. The distal end of the buckling piece 222 is forked to be formed with two elastic projecting portions 224. According to aforementioned structure, by the tenon 221 and the buckling piece 222 of the locking piece 22 are to be inserted into the through hole 212 outside the ring 211 of the arm supporter 21 and the groove 214 of the protrusion 213, respectively. The projecting portion 224 of the buckling piece 222 is buckled in the groove 214, such that tenon 221 may be buckled in the bore 11 at the rod 12 of the Y-type cane 1 or the pushing piece 223 of the locking piece 22 is pushed to release the buckling in the bore 11 on the rod 12 of the Y-type cane.

Figure 5:
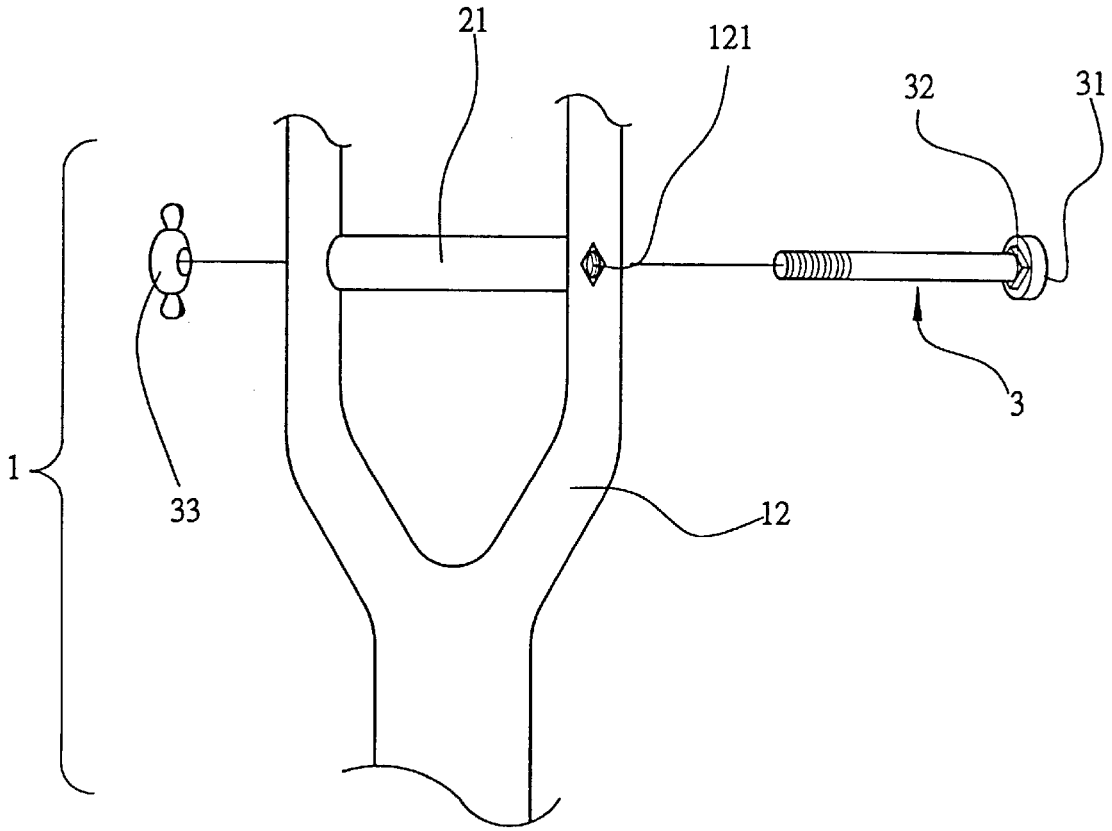
FIG. 5 (PRIOR ART)
FIG. 5 is a perspective view showing a prior art cane.

Moreover, in the prior art arm supporter of a cane (as shown in FIG. 5), each rod 12 of the Y type cane is installed with a respective screw bores 121. One of the screw hole has a square shape. An arm supporter is engaged with the rod 12 with respect to the screw hole 121 thereof. A stud 4 passes through the rods 12 and the round hole on the center of the arm supporter. The square flange 21 in the lower end of the hat rim 31 of the nut 3 is buckled in the rectangular hole of the rod 12. Moreover, the stud 3 protruded from the rod 12 is screwed with a fixing stud 33.

Therefore, it is appreciated from the aforementioned description that the present invention can improve over the prior art cane in which the stud and nut must be detached for adjusting the height of a cane.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An improved underarm cane device comprising:

a cane having a Y-type structure with an upper end portion and two rods extending therefrom;

an arm supporter structure having an arm supporter and two ends, each end of the arm supporter structure having a ring through which each one of the two rods of the upper end portion of the cane extend through, thereby positioning the arm supporter structure between the two rods of the upper end portion of the cane;

the rings each having an outer side with a through bore and a protrusion, the protrusion including a groove;

a plurality of bores longitudinally arranged along the length of each of the two rods;

a pair of L-shaped locking pieces each configured to secure one of the respective rings of the arm supporter structure to one of the rods, the L-shaped locking pieces each having a tenon, a buckling piece having a distal end, at least one pushing piece;

the tenon of each of the locking pieces configured to be secured into the bore of one of the respective rings of the arm supporter structure and into one of the bores of the respective rod; and the distal end of the buckling pieces of each of the locking pieces being forked and formed with two elastic projecting portions, the projecting portions configured to be secured into the groove of one of the respective rings of the arm supporter structure.

* * * * *